United States Patent [19]

Orphall et al.

[11] Patent Number: 4,573,643

[45] Date of Patent: Mar. 4, 1986

[54] IMPACT CRUSHERS

[75] Inventors: Axel W. Orphall, McMurray; Bernd G. Albers, New Castle, both of Pa.

[73] Assignee: A & O Engineering, Inc., Bridgeville, Pa.

[21] Appl. No.: 596,210

[22] Filed: Apr. 2, 1984

[51] Int. Cl.[4] ..... B02C 13/28

[52] U.S. Cl. ..... 241/189 R; 241/192; 241/195; 241/285 B

[58] Field of Search ..... 241/189 R, 191, 192, 241/195, 241, 285 R, 285 A, 285 B, 300, 293, 294

[56] References Cited

U.S. PATENT DOCUMENTS 3,874,603 4/1975 Lowe et al. ..... 241/191

3,979,078 4/1976 Boddeker et al. ..... 241/285 B X

FOREIGN PATENT DOCUMENTS 2916649 11/1979 Fed. Rep. of Germany ..... 241/191

*Primary Examiner*—Howard N. Goldberg

*Assistant Examiner*—Timothy V. Eley

*Attorney, Agent, or Firm*—Daniel Patch; Suzanne Kikel

[57] ABSTRACT

In an impact crusher for reducing the size of particulate material, the breaker bars having one or more quasi-circular depressions for engaging a circular back-up bar is secured to a rotor by means of a serrated wedge and C-clamp assembly. A newly designed housing opening permits the breaker bars to be placed in an optimum horizontal positioning and a rotor-locking assembly holds the back-up bars in this optimum positioning and provides support for the breaker bars during replacement thereof.

14 Claims, 8 Drawing Figures

IMPACT CRUSHERS

BACKGROUND OF THE INVENTION

The present invention relates to an impact crusher having a rotor carrying a number of breaker bars for comminuting particulate material, such as rock, ore, limestone, grain, concrete or the like, and more particularly, to an improved means for securing the breaker bars to the rotor, and means for permitting easy access into the crusher and for easy removal and installation of the breaker bars.

In impact crushers, it is well-known to provide a rotor with several replaceable breaker or impact bars mounted onto the periphery of the rotor, which may be of the open disc-type consisting of generally several disc plates mounted on a rotatable shaft. In the present open disc-type rotor, both the back-up bar and breaker bar extend between opposed disc plates. The back-up bar is welded in the opposed discs, and may either have an angular protrusion which fits into a similarly formed depression in the breaker bar as shown in U.S. Pat. No. 3,531,055 or may have an angularly formed depression for receiving a similarly formed protrusion of the breaker bar. The breaker bar is held in position by inserting a breaker bar holder or shoe against a nose of the disc plate between the breaker bar and disc plate.

During rotation of the shaft and discs, severe centrifugal forces are exerted against the sloped protrusions and depressions in the breaker bar or back-up bar, and severe lateral forces are ultimately exerted against the shoe resulting in a skewed seating for the breaker bar, and thus, reduced contact support between the breaker bar with a bottom edge of the shoe and also between the breaker bar with an upper edge of the back-up bar and between the depression and protrusion area of the breaker bar and back-up bar to the extent of insufficient support and eventual damage to the back-up bar protrusion and the disc nose.

This present design for replaceable breaker bars is extremely unconducive in establishing and maintaining self-alignment of the back-up bar, breaker bar, and shoe, and frequently results in deformation of the back-up bar and the rotor disc nose which are normally considered to be nonreplaceable components. This deformation condition of the back-up bar and disc nose often requires repair by weld built-up or machining of these fixed parts, which translates into extended downtime of the impact crusher and excessive maintenance manpower hours.

In addition, these present day designs of an impact crusher features either a substantially closed housing with only a small door in the impactor sidewall providing minimal access to the rotor and breaker bars, or an opened housing where a rear portion is hinged for pivotal movement, in which case, access to the rotor and breaker bars is improved.

However, in these housing designs as well as others it is to be appreciated that the breaker bar during its replacement is located in an undesireable position in that the back-up bar provides little or no support for the breaker bar during its installation or removal. Again, the results translates into extended downtime of the impact crushers and excessive manpower hours.

None of the present day impactor designs provides a locking device for simultaneously holding the rotor in place while at the same time providing support for the breaker bar during its removal from and installation into the housing.

SUMMARY OF THE PRESENT INVENTION

It is, therefore, an object of the present invention to provide an improved design for an impact crusher which substantially decreases the downtime of the crusher and lessens the manpower hours involved in present day impactor designs, and more particularly to provide a housing designed for easy access therein and a mounting arrangement for the breaker bar such that in conjunction with an external apparatus allows for the easy removal and replacement of the breaker bars.

A still further object of the present invention is to provide an impact crusher for reducing material particulates, such as limestone, grain, ore, and the like, comprising: a housing in which the material to be reduced is introduced, a shaft rotatably mounted in said housing, spaced apart disc plates fixedly mounted on said rotatable shaft for rotation therewith, each having an outer peripheral surface extending radially outwardly from said shaft, in which surfaces a cooperative corresponding set of slots is located, a plurality of material impact assemblies, at least one of which is mounted in each of said sets of slots, each said impact assembly comprising a breaker bar arranged parallel to said axis of said shaft received in an associated set of slots in said plates, and extending in a radial direction with respect to said plates away from said outer periphery of said plates for contacting and impacting against said material, a back-up bar for each breaker bar arranged to have at least a portion projecting in said each associated set of slots of said plates and extending parallel to an associated breaker bar in supporting engagement with one side thereof, a wedge member arranged in each of said slots of said plates between an associated surface of such plate opposite the side of an associated breaker bar for engagement therebetween, said opposite side of said plates having wedge surfaces for cooperating with said engaging surfaces of said wedge members so that any movement of the wedge member with respect to said radial direction increases the holding force thereof, a clamping member for each wedge member having two opposite sides that overlap corresponding sides of an associated wedge member and adjacent corresponding sides of said plates and arranged to be movable with said wedge members in each radial direction, and means associated with each wedge member and clamp assembly for holding the assembly as an operative unit during operation of said crusher which means when disassembled allows quick removal of said wedge member from said breaker bar for the quick disengagement of the latter from said back-up bar.

More particularly, it is an object of the present invention to provide a mounting arrangement for the breaker bars on an open disc type rotor where the breaker bar has a quasi-circular portion corresponding to the radius of a circular back-up bar, which also supports the breaker bar during its replacement, and a wedge forced in a clearance between the disc plate and breaker bar assures a tight mounting and proper alignment of the breaker bar against the back-up bar, and a C-clamp placed around the wedge keeps the wedge from moving in a direction parallel to the axis of the shaft out of the disc.

And still more particularly, a further object of the present invention is to provide a movable section of the housing located such that a workman can gain easy access into the housing where an impact assembly is positioned for replacement of its respective breaker bar such that the breaker bar is supported by its respective back-up bar, and to provide an external apparatus which can be used by the workman when the breaker bar is in this optimum positioning for the replacement of the breaker bar inasmuch as this external apparatus serves as a rotor back-up bar extension as well as a locking device for holding the rotor in place, thereby counteracting the rotational forces created by the unbalancing of the rotor caused when the breaker bar is removed from the rotor.

BRIEF DESCRIPTION OF THE DRAWINGS

These objects, as well as other novel features and advantages of the present invention, will be better appreciated and understood when the following description is read along with the accompanying drawings of which.

DETAILED DESCRIPTION OF A PREFERRED EMBODIMENT

Figure 1:
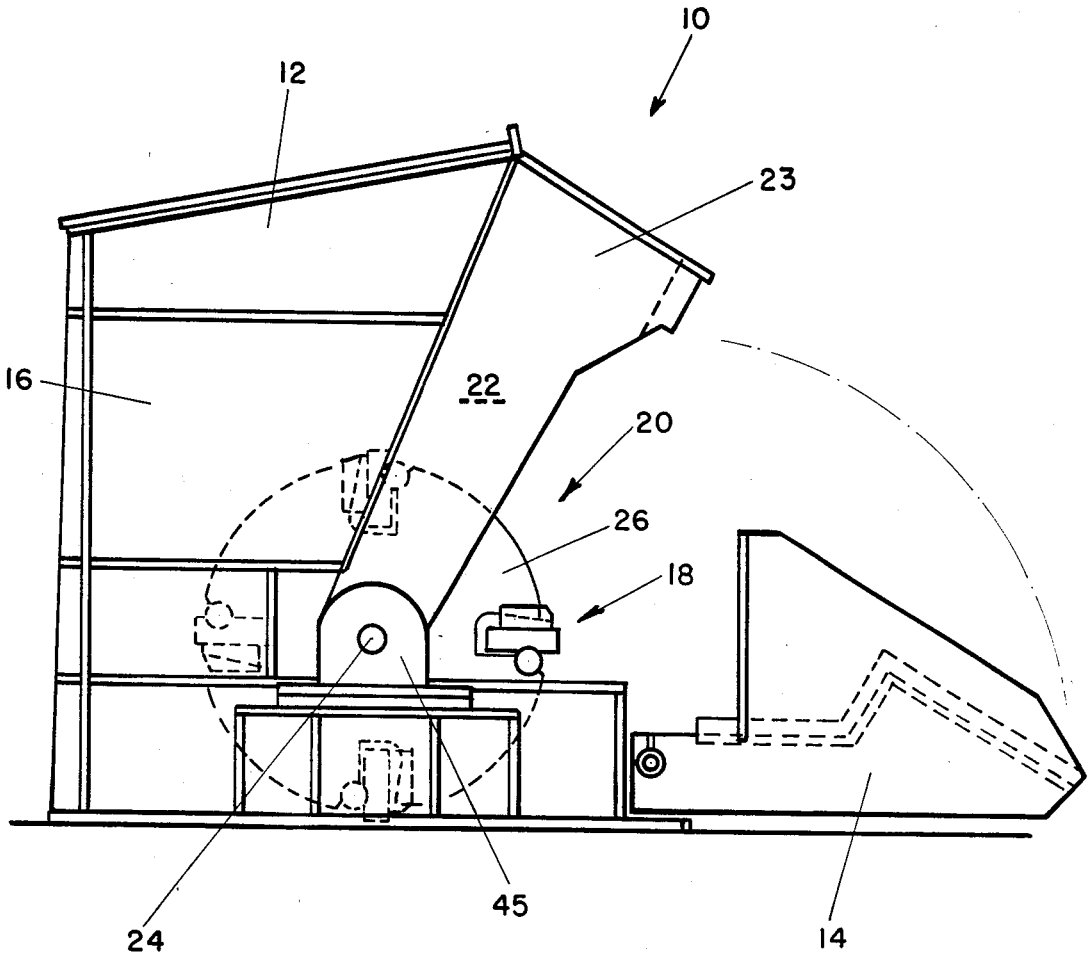
FIG. 1 is an elevational view of an impact crusher illustrating certain aspects of the present invention.

FIG. 1 shows an impact crusher 10 with its housing 12 in an opened position, i.e. with pivotal portion 14 moved away from stationary portion 16 disclosing one of the several impact assemblies 18 mounted in rotor assembly 20. It goes without saying that this is an inoperative mode for the impact crusher 10, and that when pivotal portion 14 abuts stationary portion 16, the impact crusher is in its operating mode. Hard material particulates, such as limestone, grain, ore, etc. is introduced into the chamber 22 through inlet 23 where the feed is reduced due to the collison of the feed material against the impact assemblies 18 and the impelling of the feed against several breaker plate assemblies (not shown). The breaker plate assemblies are generally suspended from the housing 12 and spaced away from rotor assembly 20 in close proximity to inlet 23. For the reduction action, rotor assembly 20 is rotated in a counterclockwise direction when looking into FIG. 1.

The principles and operation of impact crushers are further set forth in the above mentioned U.S. Pat. No. 3,531,055; and also in U.S. Pat. Nos. 3,623,674; 3,847,362; and 4,017,035. As shown in FIG. 1, rotor assembly 20 is mounted on shaft 24, which extends through housing 12, (more about which will be discussed shortly), and impact assemblies 18 are mounted on rotor assembly 20.

Figure 2:
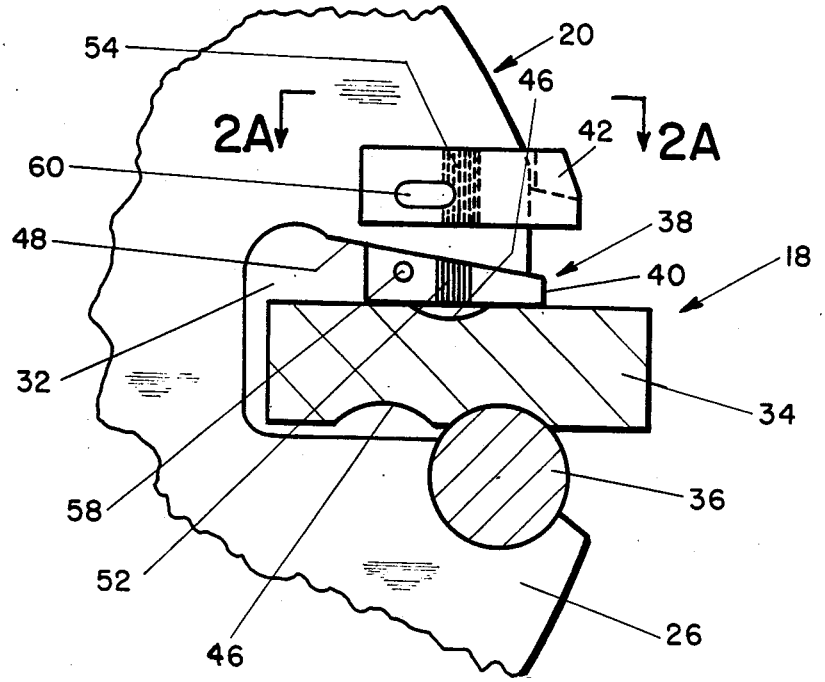
FIG. 2 is an enlarged, fragmentary view illustrating certain aspects of the present invention partly in preassembled form.
Figure 3:
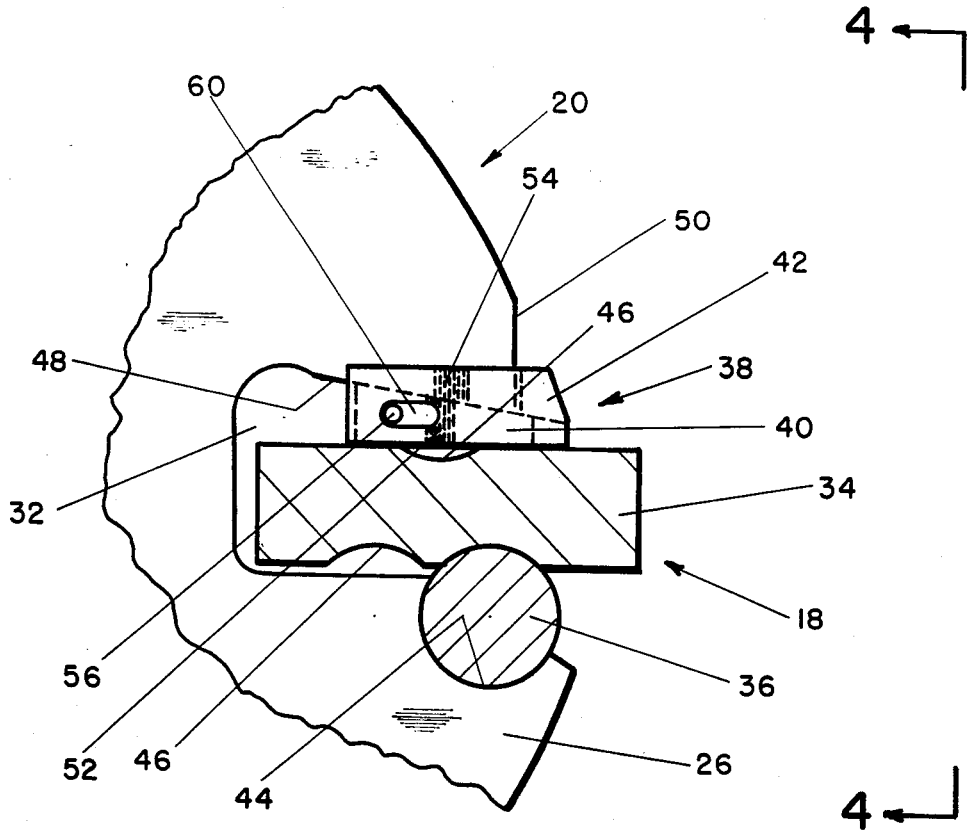
FIG. 3 is an enlarged, fragmentary view illustrating certain aspects of the present invention entirely in assembled form.
Figure 4:
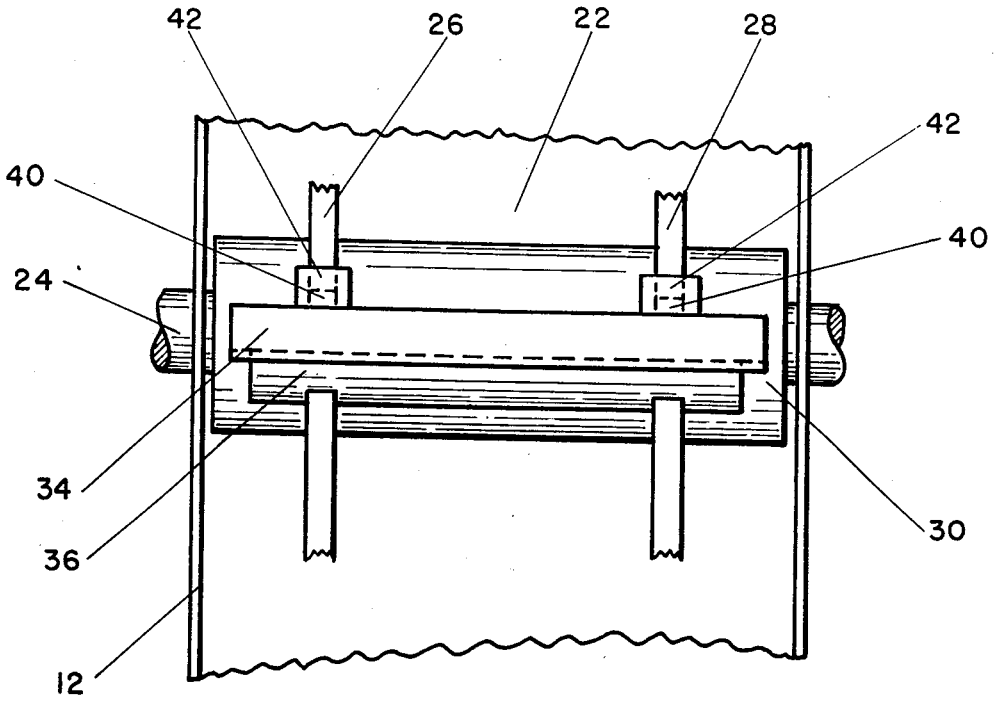
FIG. 4 is a fragmentary, front elevational view taken along lines 4—4 of FIG. 3.

These impact assemblies 18 and their mounting, in rotor assembly 20 are specifically shown in FIGS. 2, 3, and 4, where rotor assembly 20, as mentioned earlier, is an open disc type in that it consists of disc plates 26 and 28 fixedly mounted on opposite ends of a hub 30, which, in turn, is mounted onto shaft 24 mounted for rotation about an axis as is clearly shown in FIG. 4. In FIGS. 2 and 3, each of these disc plates 26 and 28 has an outer periphery extending radially outwardly away from hub 30 where a number of open slots 32 (one of which is only shown in FIGS. 2, 3, and 4), are circumferentially spaced on the outer periphery of each disc plate 26 and 28. Slots 32 of plate 26 cooperate with those of opposing disc plate 28 to receive an impact assembly 18. Each impact assembly 18 consists of a breaker bar 34, a circular back-up bar 36, and a wedge and clamping assembly 38 consisting of a wedge member 40 and clamp member 42, as specifically shown in their assembled form in FIG. 2*a*.

As FIGS. 1, 2, and 3 show, breaker bar 34 extends away from the edge of disc plates 26 and 28, and circular back-up bar 36 is received in a cut-out portion 44 of disc plate 26 adjacent to slot 32 where it is permanently held in place by welding, whereas breaker bar 34, in addition to the wedge and clamping assembly 38 are easily removable and replaceable items. While not shown in the Figures, it is understood that the disc plate 28 also has a cut-out portion 44 for receiving the opposed end of back-up bar 36. In order for both back-up bar 36 and breaker bar 34 to be positioned in the slots 32 of disc plates 26 and 28, as shown in FIG. 4, they extend almost the entire length of hub 30 in chamber 22 of housing 12. Also, as shown in FIG. 4, hub 30 extends across the width of chamber 22, and shaft 24 protrudes out of the two sides of housing 12 where it is mounted in pillow block bearings 45 for rotation thereof (FIG. 1).

Still referring to FIGS. 1, 2 and 3 along the two longitudinal sides of breaker bar 34, there are one or more circular segment indentations 46 having a radius corresponding to that of a portion of circular bar 36 for engagement therebetween. Wedge member 40 is tightly positioned between breaker bar 34 and a sloped surface 48 in slot 32. Extending down to slot 32 in disc plate 26 is a straight leading edge 50. Wedge member 40 is held in its position in slot 32 through clamp member 42 which has a "C" configuration and which is placed around leading edge 50, and moved down onto and around wedge member 40 and disc plate 26 as progressively shown in FIGS. 2 and 3, respectively.

Figure 2A:
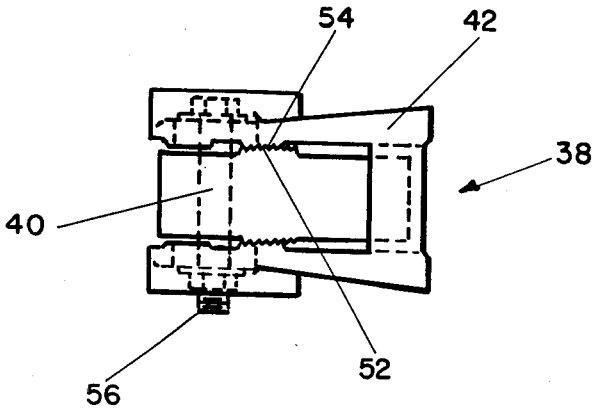
FIG. 2*a* is an enlarged plan view showing certain aspects of the present invention in assembled form.

Wedge and clamping members 40 and 42, respectively, have matching serrations 52, 54 on their corresponding engageable surfaces, i.e. on the outer surfaces of wedge member 40 and the inner surfaces of C-clamp member 42, so that the serrations 54 of clamp member 42 engage serrations 52 of wedge 40 when clamp 42 is brought down over wedge 40 for their assembled form, shown in FIGS. 2*a* and 3. Depending on the clearance between breaker bar 34 and sloped surface 48, wedge 40 will be positioned therebetween to take up this clearance such as to always establish a tight fit. Since this positioning of wedge 40 may vary according to this clearance between surface 48 and breaker bar 34, only some of the serrations on C-clamp 42 may engage those on wedge 40 as shown in FIG. 3. This condition in FIG. 3 is still sufficient to hold wedge 40 in a tight fit relationship for breaker bar 34 in disc plates 26 and 28.

As shown in FIGS. 2*a* and 3, bolt 56 is inserted through openings 58 and 60 of wedge and clamp members 40, 42 for their fastening together, opening 60 being of a slot-type configuration.

As a result of this, the C-clamp 42 and wedge 40 move as a unit in the radial direction, but the C-clamp prevents the wedge from moving in an axial direction relative to the axis of the shaft. Wedge 40 in engagement with wedge surface 48 and breaker bar 34 is such that any movement of wedge member 40 in the radial direction increases the holding force on breaker bar 34. Such a wedge and clamping assembly 38 is provided for mounting breaker bar 34 into each disc plate 26, 28, disc 28 having the same slot configuration as slot 32 in FIGS. 2 and 3. FIG. 4 shows this assemblage of clamp 42 and wedge 40 on both ends of breaker bar 34 and back-up bar 36 in slots 32 of each of disc plates 26 and 28.

As shown in FIG. 3, breaker bar 34 is nested against circular back-up bar 36 via circular segmental depressions 46 in breaker bar 34. The radius of each depression 46 and the corresponding radius of circular back-up bar 36 allows for the optimum alignment of breaker bar 34 and wedge 40 when these members 34 and 40 are inserted into slots 32 between back-up bar 36 and sloped surface 48 of disc plates 26, and 28, and enables a tight fight between these elements and impact assembly 18 such that the possibility of breaker bar 34 becoming askewed in slot 32 during the contacting of the material against breaker bar 34, which condition occurs in designs of the prior art, is substantially decreased or eliminated.

In discussing the replacement of breaker bar 34 in rotor assembly 20, reference is made first to FIG. 1. Movable portion 14 located below material inlet 23 is swung away from fixed portion 16, allowing easy access to impact assemblies 18. If impact assembly 18 shown in hard line is in a position other than that shown in FIG. 1, but at an angle somewhere between 0° and 90° (3 o'clock and 12:00 o'clock), then shaft 24 is manually rotated in a direction to horizontally position impact assembly 18 as shown in FIG. 1. For replacement of the breaker bar 34, clamp 42 is first moved upwardly and then outwardly to the right of FIG. 3, and wedge 40 is forced inwardly into slot 32 to the left of FIG. 3, thereby leaving only the need for the removal of breaker bar 34 which will be explained with reference to FIGS. 5, 6, and 7.

Easy removal of clamp 42 and wedge 40 is achieved due to their design as individual components. This is contrary to the designs of the prior art having shoes in that these shoes tend to get forced into position around the disc nose due to the severe centrifugal forces which cause a skewing of the breaker bar relative to the back-up bar and shoe thereby creating spaces between these elements. Fine crushed particles built up in these spaces resulting in cementation and thus preventing removal of the breaker bar or shoe.

Figure 6:
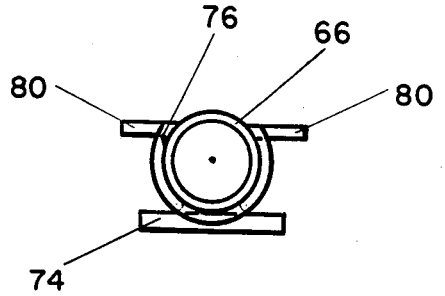
FIG. 6 is an enlarged elevational view taken along lines 6—6 of FIG. 7.
Figure 7:
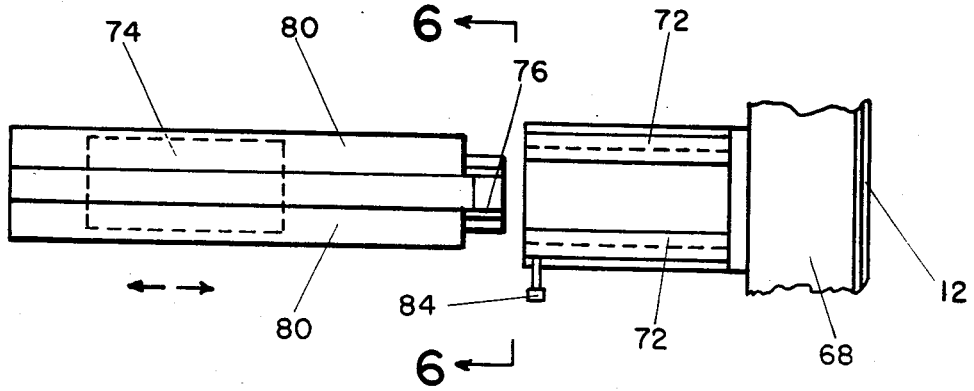
FIG. 7 is a plan view taken along lines 7—7 of FIG. 5.
Figure 5:
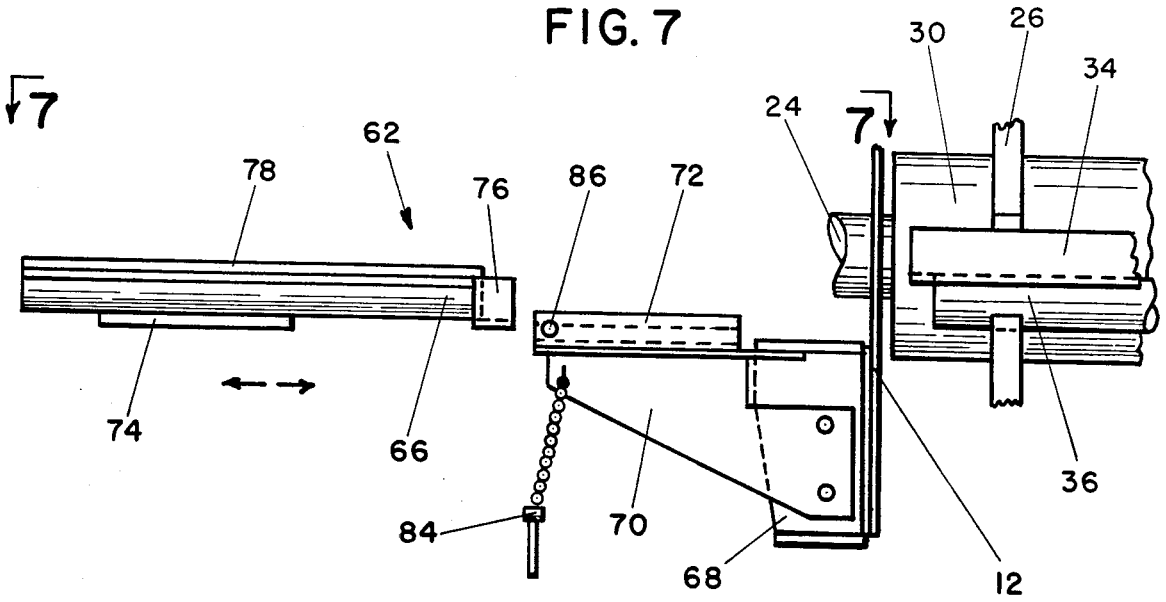
FIG. 5 is a front, elevational view illustrating certain aspects of the present invention externally of the housing of an impact crusher.

In FIGS. 5, 6, and 7 there is shown an apparatus 62 for removing breaker bar 34, which consists generally of sections 66, and 70. Section 70 is mounted to the outside of housing 12 of impact crusher 10 (FIG. 1) through base member 68 to which member 70 is mounted. On top of member 70 is a guide track portion 72 for receiving section 66, which has a slideable rail 74 fitting into guide track 72 of section 70. Mounted at one end of section 66 is segment 76 in the form of a partial circle having a slightly larger inner diameter than the external diameter of back-up bar 36 so that the former can easily engage and hold back-up bar 36. This segment 76 can be made from a pipe whose top portion is sheared off as shown in FIGS. 6 and 7. Mounted on top section 66 are two winged portions 80 extending outwardly are two winged portions 80 extending outwardly to form a surface which will be in line with the bottom of breaker bar 34 and has a width and length such as to substantially support breaker bar 34.

For operation of external apparatus 62 for the removal of breaker bar 34, section 66 is caused to slide to the left when particularly, referring to FIG. 5 to fit into section 70 where slide rail 74 of section 66 engages guide track 72 of section 70 until member 76 fully engages back-up bar 36.

To affix section 66 into section 70, a pin 84 is inserted through an opening 86 in guide track 72 behind section 66. Apparatus 62 now acts as a rotor assembly locking device which holds back-up bar 36 in the horizontal positioning shown best in FIG. 1, whereby shaft 24 is prevented from rotating. Thus, the rotational forces normally created by the unbalancing of the rotor caused when a breaker bar 34 of an impact assembly 18 is removed is counteracted by utilization of apparatus 62. As is apparent, external apparatus 62 also functions as an extension for the back-up bar 36 during the replacement of breaker bar 34.

At this point, the operator slides breaker bar 34 out from impact crusher 10 onto plate member 80 where the circular protrusion of member 66 above plates 80 matches and engages one of the circular depressions 46 in breaker bar 34. Breaker bar 34 while supported by member 60 and portions 80 continues to be manually pulled out of housing 12.

During removal, breaker bar 34 remains supported by back-up bar 36, and then back-up bar 36 serves as a continuation for supporting the remaining portion of breaker bar 34 in housing 12 until breaker bar 34 is brought completely out of the housing where it is entirely supported by members 66 and 80. A new breaker bar can then be placed on members 66 and 80 and pushed back into housing 12 in the reverse manner for the removal of the worn breaker bar.

Each of the breaker bars 34 of impact assembly 18 can be removed, replaced or repositioned in a similar fashion where each impact assembly 18 is first positioned in a horizontal or a 3 o'clock positioning as shown in FIG. 1, then wedge and clamp assembly 38 from each disc plate 26, and 28 are quickly removed, and external apparatus 62 is used to lock rotor assembly and then acts as an extension to provide support for breaker bar 34.

From the above, it can be appreciated that the downtime and man hours normally required to remove a worn breaker bar and install a new one is greatly reduced due to the design of apparatus 62 as compared to present impactor designs where no such apparatus exist. In such an instance where apparatus 62 is not available, a workman must pull breaker bar 34 axially out of housing 12 to where it can be separated from discs 26 and 28 and then manually held at which point it becomes very difficult and dangerous due to the substantial weight of the breaker bar 34.

When breaker bar 34 wears down on one side, it is to be noted that depressions 46 permit the breaker bar 34 to be either further extended outwardly or turned around and positioned such that the non-worn section of breaker bar 34 protrudes outwardly away from the peripheral portions of disc plates 26 and 28.

It is to be appreciated that the present invention has been described in light of two disc plates, but more than two can be arranged across the width of the housing to accommodate one or more breaker bars and back-up bars where a wedge and clamp assembly 38 is associated with each disc plate.

In accordance with the provisions of the patent statutes, we have explained the principle and operation of our invention and have illustrated and described what we consider to represent the best embodiment thereof.

We claim:

1. In an impact crusher for reducing material particulates, such as limestone, grain, ore, and the like comprising:

a housing in which said material to be reduced is introduced, and a rotor assembly in said housing having several impact assemblies consisting of breaker bar means and back-up bar means and arranged around the outer periphery of said rotor assembly for contacting and impacting said material, said housing consisting of at least two separate portions one movable relative to the other, said movable portion being constructed and arranged to be in a closed and opened position wherein in said opened position there is provided ready access into said housing at a location where each said impact assembly is successively positionable for replacement of its respective breaker bar means such that the said breaker bar means is supported by its respective back-up bar means or said back-up means is substantially below said breaker bar means and, extension means located outside said housing in alignment with said impact assembly which is positionable for said replacement of its respective breaker bar means, said extension means arranged to cooperate with said positioned back up bar means to provide a substantial continuous support for said positioned breaker bar means and includes means for engaging said back up bar means of said positioned assembly constructed and arranged such that said shaft is held against rotational movement, and further includes means for receiving and supporting said breaker bar means upon its removal and replacement to and from said positioned impact assembly.

2. In an impact crusher for reducing material particulates such as limestone, grain, ore and the like comprising:

a housing in which the material to be reduced is introduced, a shaft rotatably mounted in said housing, spaced apart disc plates fixedly mounted on said rotatable shaft for rotation therewith each having an outer peripheral surface extending radially outwardly from said shaft, in each of which surface a plurality of slots are located and wherein the slots in a said disc plate cooperate with slots in the other said disc plates to define sets of slots, a plurality of material impact assemblies, each one of which is mounted in a different one of said sets of slots, each said impact assembly comprising:

breaker bar means arranged parallel to said axis of said shaft and received in an associated said set of slots in said plates, and extending radially outwardly from said one set of slots for contacting and impacting against said material, back-up bar means for said breaker bar means constructed and arranged to have at least a portion projecting into said set of slots and extending parallel to said breaker bar means in supporting engagement with one side thereof, a wedge member arranged in each slot of said set of slots between an associated surface of said plate and said breaker bar means for engagement therebetween, said surface of said plate cooperating with said engaging surface of said wedge member so that any movement of said wedge member with respect to said radial direction increases the holding force thereof, a clamping member for said wedge member constructed and arranged to engage said wedge member and said peripheral surface of said plate, in a manner to be movable with said wedge member in said radial direction, and means for holding said wedge member and said clamping member together as an operative unit during operation of said crusher, which holding means in an inoperative mode allows quick removal of said wedge member from said breaker bar means for the quick disengagement of the latter from said back-up bar means.

3. In an impact crusher according to claim 2, wherein said housing consists of at least two separate portions, one movable relative to the other, said movable portion constructed and arranged to be in a closed and an opened position, wherein in said opened position there is provided ready access into the interior of said housing at a location where each said impact assembly is successively positionable for replacement of its respective breaker bar means, said location being such that the associated back up bar means supports its breaker bar means.

4. In an impact crusher according to claim 3, wherein said movable portion is pivotally mounted and further consists of means for effecting said pivotal movement thereof.

5. In an impact crusher according to claim 4, wherein said means for effecting movement is a piston cylinder assembly.

6. In an impact crusher according to claim 3 further comprising:

extension means located outside said housing in alignment with said impact assembly which is positionable for said replacement of its respective breaker bar means said extension means arranged to cooperate with said positioned back up bar means to provide a substantial continuous support for said positioned breaker bar means and includes means for engaging said back up bar means of said positioned assembly constructed and arranged such that said shaft is held against rotational movement, and further includes means for receiving and supporting said breaker bar means upon its removal and replacement to and from said positioned impact assembly.

7. In an impact crusher according to claim 6 or 1, wherein said extension means further includes a first portion mounted alongside said housing and a second portion slideable in said first portion, and wherein said back-up bar engaging means and said means for receiving and supporting said breaker bar means is mounted on said second portion.

8. In an impact crusher according to claim 7, wherein said back-up bar engaging means consists of a relatively circular segment having a radius corresponding to that of said back-up bar means and mounted at one end of said second portion, and wherein said receiving and supporting means for said breaker bar means consists of a relatively flat portion mounted on top of said second portion.

9. In an impact crusher according to claim 3, wherein said shaft is arranged in a horizontal plane and said replacement positioning of said impact assembly with its respective breaker bar and back up bar means is located approximately in a plane perpendicular to a vertical plane passing through said axis of said shaft.

10. A rotor assembly for use in a crushing machine or the like for reducing material, such as limestone, grain, ore and the like, comprising:

a rotatably mounted shaft having an axis of rotation, spaced-apart disc plates fixedly mounted on said rotatable shaft for rotation therewith, each having an outer peripheral surface extending radially outwardly from said shaft, in which surfaces there is located at least one cooperative corresponding slot, breaker bar means arranged parallel to said axis of said shaft received in said at least one slot in said each plate, and extending radially outwardly from said slot for contacting and impacting against said material, a back-up bar means for each breaker bar means constructed and arranged to have at least a portion projecting in said at least one slot of said each plate and extending parallel to the axis of the rotor assembly shaft and to said breaker bar means in supporting engagement with one side thereof, a wedge member arranged in said at least one slot of said each plate between an associated surface of said plate and said breaker bar means for engagement therebetween, said surface of said plate cooperating with said engaging surfaces of said wedge member so that any movement of the wedge member with respect to said radial direction increases the holding force thereof, a clamping member for said wedge member constructed and arranged to engage said wedge member and said peripheral surface of said associated plate in a manner to be movable with said wedge member in said radial direction, and means for holding said wedge member and said clamping member together as an operative unit during operation of said crushing machine, which holding means in an inoperative mode allows quick removal of said wedge member from said breaker bar means for the quick disengagement of the latter from said back-up bar means.

11. In an impact crusher according to claim 2 or 10 wherein said holding means for said wedge member and clamp member unit comprises engageable means on an inner surface of said clamping member and on an outer cooperating surface of said wedge member in an area where said engaging of said wedge member by said clamping member occurs.

12. In an impact crusher according to claim 11, wherein said holding means for said each unit further comprises fastening means extending through its said wedge and clamping members for securing said two members together on said each disc plate.

13. In an impact crusher according to claim 11, wherein said engageable means includes a section on said surfaces of said wedge member and said clamp member having serrated edges constructed in a manner to allow said wedge and clamp members to be positionable relative to each other in said radial direction and yet still be held by the latter.

14. In an impact crusher according to claim 2 or 10, wherein said back up bar means has a circular contacting surface with said breaker bar means, and wherein a surface of said breaker bar means in supporting engagement with said back up bar means has at least one circular depression with a radius corresponding to that of said circular surface of said back up bar means.

* * * * *